United States Patent [19]

Holub

[11] 4,044,843

[45] Aug. 30, 1977

[54] TRACTOR-MOUNTED SCRAPER

[76] Inventor: Arnold Emeral Holub, 1611 Ayers Road, Concord, Calif. 94521

[21] Appl. No.: 679,217

[22] Filed: Apr. 22, 1976

[51] Int. Cl.[2] ..... E02F 3/76

[52] U.S. Cl. ..... 172/802; 172/806; 172/803

[58] Field of Search ..... 172/800, 802, 803, 806, 172/807, 804; 37/141 R

[56] References Cited

U.S. PATENT DOCUMENTS

| | | | |
|---|---|---|---|
| 1,856,148 | 5/1932 | Ball | 172/136 |
| 2,657,481 | 11/1953 | Larsen | 37/124 |
| 2,841,897 | 7/1958 | Duke | 37/141 R X |
| 3,007,265 | 11/1961 | Harris | 172/802 |
| 3,034,238 | 5/1962 | McGee | 172/719 |
| 3,590,929 | 7/1971 | Wirt | 172/803 |
| 3,653,451 | 4/1972 | Fryrear | 172/806 |

FOREIGN PATENT DOCUMENTS

| | | | |
|---|---|---|---|
| 47-20503 | 6/1972 | Japan | 172/806 |

*Primary Examiner*—Richard J. Johnson
*Attorney, Agent, or Firm*—Rankin A. Milliken

[57] ABSTRACT

A tractor-mounted scraper is disclosed in which the scraper blade has two scraping edges and is mounted in a box assembly having two side plates, the blade being mounted on pivots located near the lower edges of the side plates and near the outer edges of the side plates, remote from the tractor. The box assembly is mounted on one end of the tractor, on pivoted arms which are maintained parallel to each other. A power-operated tilting head is mounted rigidly on the parallel arms, and the side plates are rigidly mounted on the moving part of the tilting head by means of a transverse beam, so that the blade neither wanders from side-to-side with respect to the longitudinal axis of the tractor, nor is permitted to tilt with respect to the axis of the pivots by which the attachment is mounted to the tractor, except as permitted by the power-operated tilting head. A hydraulic cylinder is provided for (a) raising the blade and side plates out of contact with the ground, (b) pressing downwardly on the blade and side plate assembly so that the end of the tractor nearest the attachment is supported solely by the blade, and (c) permitting the blade to rest upon the ground, bearing the weight of the side plates, the beam, the tilting head, etc., but not bearing the weight of the tractor, when hydraulic cylinder is in its neutral, unpowered condition. A hydraulic cylinder is also provided for tilting the blade about its pivots, to lower one or the other of blade's two scraping edges.

3 Claims, No Drawings

TRACTOR-MOUNTED SCRAPER

BACKGROUND OF THE INVENTION

1. Field of the Invention

The present invention relates to scraper attachments for tractors and the like and more particularly to scraper attachments which are under precise control by the tractor operator, and do not permit "wandering" of the blade from side-to-side, nor permit transverse tilting of the blade, except in response to controls on the tractor manipulated by the operator.

2. Description of the Prior Art

Tractor-mounted scrapers are well known in the prior art. The tractor-mounted scrapers of the prior art have in general , however, had their blades flexibly mounted, as by means of combinations of knuckle-joints, and/or independently-pivoted arms, so that their blades responded to meeting resistance by tilting, wandering to one side, or riding up over the resisting matter. These prior art tractor-mounted scrapers, with their blades thus mounted, not only failed to take optimally deep cuts, limited only by the stalling of the tractor power plants, but were also characterized by wandering or imprecise tracking of their blades, in the sense that their blades failed to follow the path of their tractors themselves with the requisite precision.

Further, the downward forces on the blades of the tractor-mounted scrapers of the prior art were provided entirely by the weight of the blades themselves, and the weight of their support assemblies. This lack of downward force on the blades of tractor-mounted scrapers of the prior art was in substantial part responsible for the tendencies of these prior art devices to take insufficiently deep cuts, i.e., cuts of depth considerably less than that which would result in stalling of the tractor.

SUMMARY OF THE INVENTION

Accordingly, it is an object of the present invention to provide a tractor-mounted scraper the blade of which will track the path of the tractor with considerably greater precision than that characterizing the devices of the prior art.

Another object of the present invention is to provide a tractor-mounted scraper which will not tilt in response to the meeting of obstacles, or ride over such obstacles, but rather will bring the full force of the tractor power plant to bear in attempting to remove the obstacle, to the point of stalling the tractor power plant.

A further object of the present invention is to provide a tractor-mounted scraper in which the full weight of one end of the tractor can be brought to bear on the scraper blade and its associated assembly, in order to prevent the blade from riding over obstacles.

A still further object of the present invention is to provide a tractor-mounted scraper having side walls which coact with scraper blade to entrap earth removed by the scraper blade so that it can be drawn to one end of the cut being made with the scraper.

An additional object of the present invention is to provide a tractor-mounted scraper the blade of which tilts transversely with respect to the tractor only in response to forces impressed by power-operated means under control of the tractor operator, and not in response to the meeting of an obstacle.

Other objects of the present invention will in part be obvious, and will in part appear hereinafter.

The present invention, accordingly, comprises the apparatus embodying the features of construction, combinations of elements, and arrangements of parts exemplified in the following detailed disclosure, and the scope of the present invention will be indicated in the appended claims.

In accordance with a principal feature of the present invention a tractor-mounted scraper comprises a "box" including two side plates interconnected by a transverse beam, which beam is so mounted on the end of the tractor as to be constrained to remain parallel to the axis of the mounting pivots affixed to the end of the tractor, and the blade is mounted transversely between said side plates.

In accordance with another principal feature of the present invention, a hydraulic cylinder is provided for pressing down on the beam-side plate assembly, which hydraulic cylinder can selectively (1) raise that assembly and the blade from the ground, (2) force said assembly downward about the pivot means at the end of the tractor so far that the end of the tractor is supported solely by the blade and the assembly, and (3) permit the blade and assembly to rest upon the ground, bearing the weight of the blade and its associated assembly, but not bearing any part of the weight of the tractor.

In accordance with a further aspect of the present invention, such a scraper attachment is provided with power-operated tilting means for tilting the beam and the blade transversely with respect to the tractor, but at the same time the beam is mounted to the tractor in such a manner that it can tilt only in response to the power-operated tilting means, and not in response to the meeting of obstacles by the blade.

In accordance with a still further aspect of the present invention, hydraulic means are provided for tilting the blade about a transverse axis extending from one side plate to the other, whereby either one of two scraping edges of the blade are presented for scraping action.

In accordance with another aspect of the present invention the side plates cooperate with the blade to entrap a large portion of the earth removed by scraping, so that it can be drawn by the scraper to one end of the cut made by the scraper, or to both ends of the cut made by the scraper.

For a fuller understanding of the nature and objects of the present invention, reference should be had to the following detailed description, taken in conjunction with the drawings.

DESCRIPTION OF THE PREFERRED EMBODIMENT

Figure 1:
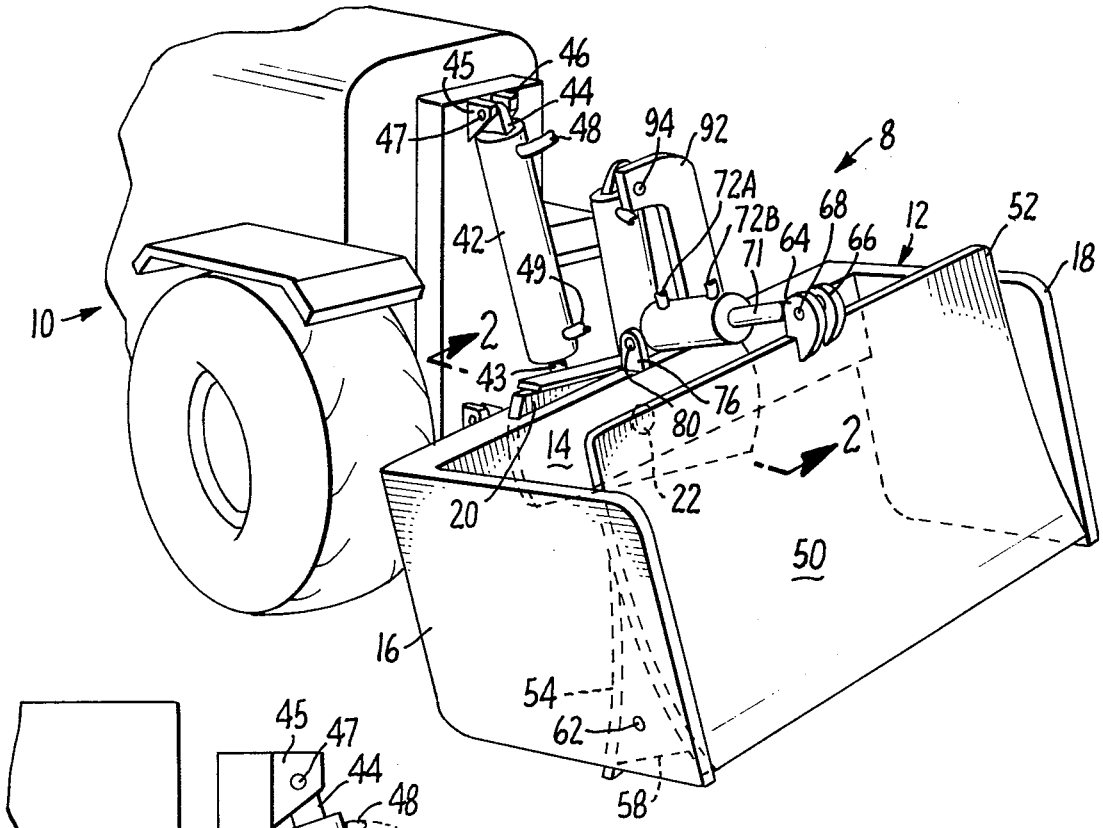
FIG. 1 is a perspective view of a tractor-mounted scraper embodying certain features of the present invention, partly in phantom.

Referring now to the drawing, there is shown in FIG. 1 a scraper embodying the present invention. The scraper of FIG. 1 comprises a scraper blade supporting and positioning assembly 8 mounted on a tractor 10. In order to fully carry out the principles of the present invention, tractor 10 should be a four wheel drive tractor, i.e., a tractor having all four of its wheels powered, so that the wheels remote from assembly 8, which are arbitrarily called the "front wheels" therein, are capable of propelling the scraper, i.e., tractor 10 and assembly 8, over the ground even when the rear wheels (nearest assembly) are raised out of contact with the ground by means of a hydraulic cylinder 42, as hereinafter explained, or should be equipped with treads of conventional type.

Tractor 10 is also provided with a compressor (not shown) of the conventional type, and driver-operably hydraulic control means, whereby hydraulic fluid under pressure is controllably supplied to hydraulic cylinders 42, 72, and 82, of assembly 8 in order to carry out the operational principles of the present invention in the manner described hereinafter.

Both tractor 10 and its associated hydraulic power system and controls may be of well-known types, or may be assembled from conventional elements without exercise of invention, and thus are not described or shown herein.

Assembly 8 comprises a frame 12, sometimes called the "box" herein.

Box 12 comprises a beam 14. A pair of side plates 16, 18 are affixed to the opposite ends of beam 14, as by welding.

Beam 14 is pivotably mounted on a plate 20 by means of a pivot pin 22. Thus, by means of plate 20 and pivot pin 22, box 12 is pivotably mounted for pivoting about an axis which is parallel to the upper edges of side plates 16, 18 and is located slightly therebelow.

Figure 2:
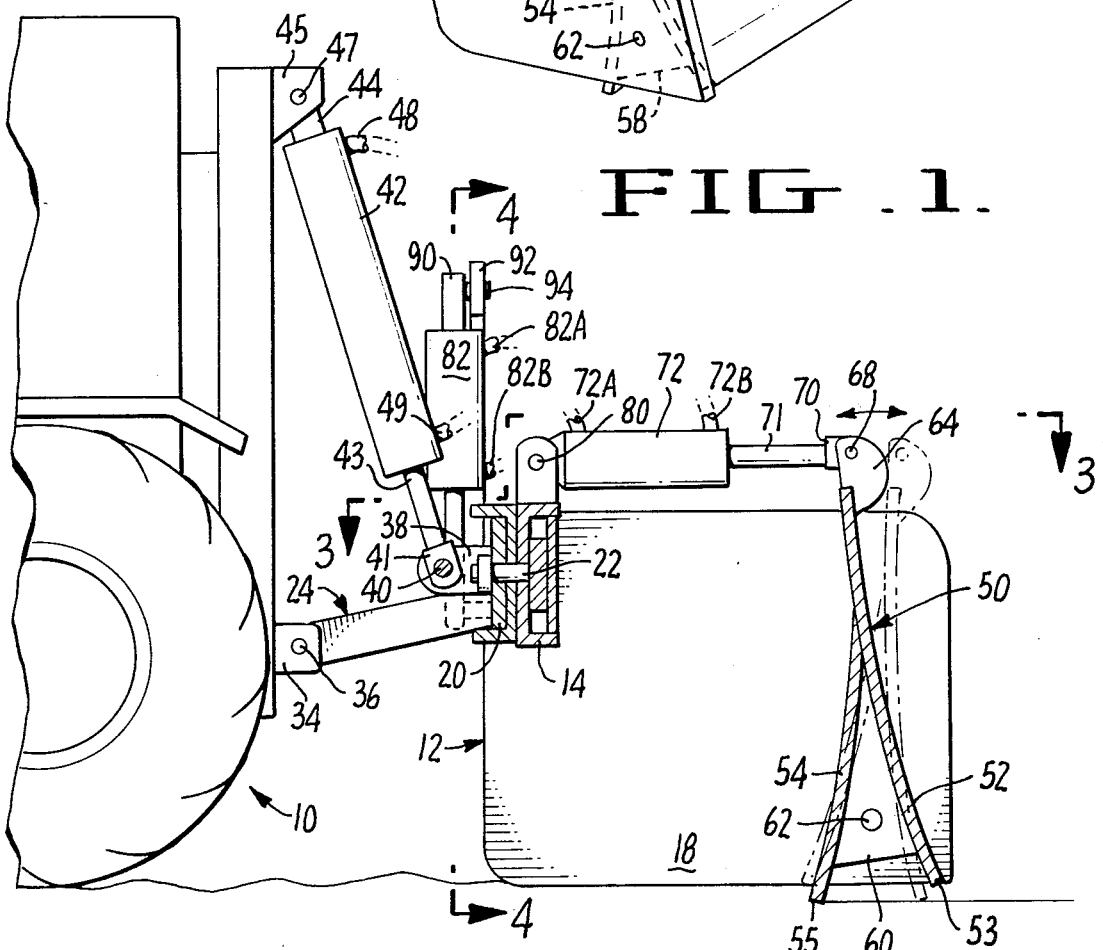
FIG. 2 is an enlarged fragmentary vertical sectional view taken on line 2—2 of FIG. 1.
Figure 3:
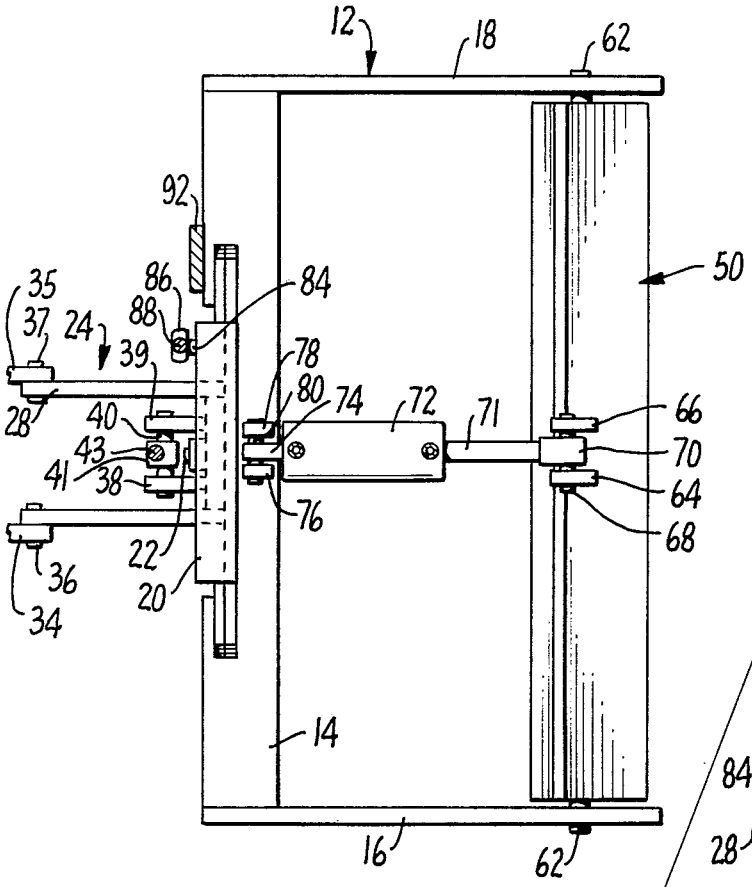
FIG. 3 is a plane view of the tractor-mounted scraper of FIGS. 1 and 2.

As best seen by comparing FIGS. 2 and 3, assembly 8 is mounted on tractor 10 by means of an arm 24, which is itself comprised of two side members 26 and 28. Going to FIG. 5, it will be seen that the ends of side members 26 and 28 of arm 24 remote from tractor 10 are respectively attached to the assembly comprising plate 20 by means, for instance, of weld beads 30 and 31, and thereby constrained to remain parallel to each other at all times. It will also be seen that plate 20 is constrained to remain parallel to axis of the pivot pins by which arms 26 and 28 are pivotably mounted on tractor 10.

The ends of the side members 26, 28 or arm 24 which are nearest to tractor 10 are individually, pivotably affixed to the end of tractor 10 which is arbitrarily called the rear end thereof by means of lugs 34, 35 and pivot pins 36, 37. Lugs 34 and 35 may, for instance, be affixed to the rear end of tractor 10 by welding. Pivot pins 36 and 37 are provided with retaining means selected from among the types well known to those having ordinary skill in the art, whereby they are retained in registering holes in the lugs 35 and 36 and the ends of side members 26 and 28.

Figure 5:
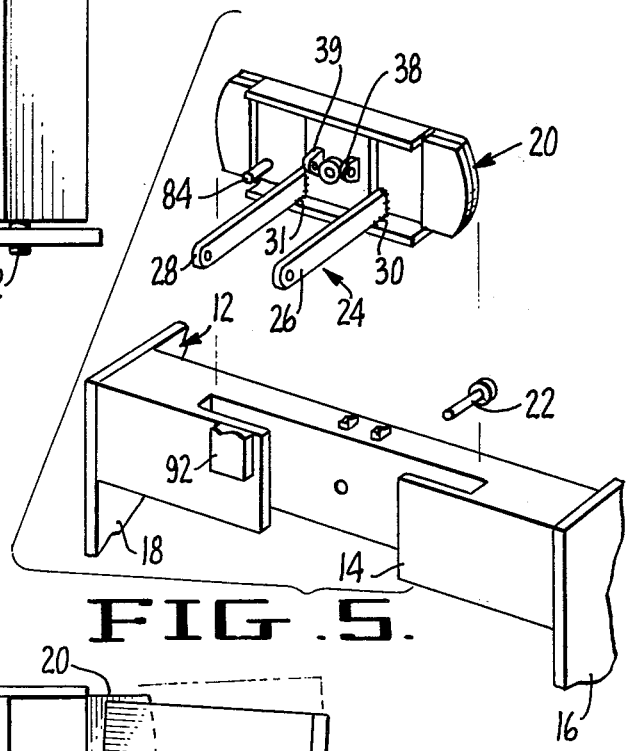
FIG. 5 is a fragmentary exploded view in perspective of the box beam of a tractor-mounted scraper embodying the present invention, and the means whereby it is tiltably mounted on the parallel arms by which the box assembly is pivotably affixed to one end of the tractor.

As best seen in FIG. 5, a pair of lugs 38, 39 ae affixed to the face of the assembly including plate 20 which lies nearest tractor 10 by means of arc welding, for instance. A pivot pin 40 (FIGS. 2 and 3) passes through and is retained in lugs 38 and 39. A block 41 contains a passage with closefittingly receives pivot pin 40, and thus block 41 is pivotably mounted on pin 40. As seen in FIG. 2, a hydraulic cylinder 42 is provided in the usual manner, with a piston rod 43, and the end of piston rod 43 is attached to block 41.

Going to FIG. 1, it will be seen that the end of cylinder 42 opposite piston rod 43 is provided with an ear 44 in the conventional manner.

As also seen in FIG. 1, a pair of lugs 45, 46 are affixed to the end of tractor 10, as by welding. A pivot pin 47 passes through suitable bores in lugs 44, 45, 46, and thus the upper end of cylinder 42 is pivotably affixed to the rear end of tractor 10.

In accordance with the principles of the present invention, cylinder 42 is supplied with operating fluid under pressure, from the above-mentioned compressor mounted on tractor 10, by means of hydraulic hoses 48, 49 of the well-known kind.

Cylinder 42 and its associated compressor and controls may be of the double-action type, wherein working fluid under pressure can be injected into cylinder 42 either above or below the piston attached to piston rod 43, and the opposite side of the piston simultaneously vented to a sump, whereby both the upward and downward strokes of piston 42 are power strokes.

As will now be evident to those having ordinary skill in the art who have studied this specification thus far, and the accompanying drawings, piston rod 43 can, under control of the driver sitting on the seat tractor 10, be drawn further into cylinder 42 than is shown in FIG. 2, and thus box 12 can be raised from the ground.

Conversely, and in accordance with a principal feature of the present invention, piston rod 43 can, under control of the driver sitting on the seat of tractor 10, be forcibly extended considerably further out of cylinder 42 than is shown in FIG. 2, and thereby the scraper blade 50 which is mounted in box 12 can be forced against the ground behind tractor 10, thus picking the rear wheels of tractor 10 off the ground, and bringing the full weight of the scraper, i.e., tractor 10 and assembly 8, to bear on scraper blade 50 and the front wheels of tractor 10. As pointed out hereinabove, tractor 10 must be powered through its front wheels, and must be sufficiently powerful to propel the scraper over the ground when the rear wheels of the tractor are raised from the ground, and the full weight of the tractor is borne by the front wheels of the tractor and the scraper blade 50.

In accordance with another feature of the present invention, the driver-operated hydraulic which are mounted on tractor 10 to enable the driver to control the working fluid pressure in cylinder 42 may be put in a "neutral" position, wherein both the space above the piston and the space below the piston in cylinder 42 are interconnected to the sump of the hydraulic system mounted on tractor 10. Thus, when the hydraulic controls mounted on the tractor for controlling lifting cylinder 42 are put in neutral position, cylinder 42 exerts neither upward or downward forces on box 12, and scraper blade 50 rests or drags on the ground, carrying the weight of the scraper blades supporting and positioning assembly 8, except cylinder 42, but not carrying the weight of tractor 10.

The mode of operation of the device of the invention just described is sometimes called the "floating mode;" whereas the earlier described mode of operating, with the scraper blade 50 bearing a substantial part of the weight of tractor 10, is sometimes called the "pressure mode" herein.

As best seen in FIG. 1, scraper blade 50 extends from side plate 16 to side plate 18 of box 12, and is largely contained within box 12.

Blade 50 comprises a major blade portion 52 (see FIG. 2), having a scraping edge 53, and a minor blade portion 54, having a scraping edge 55.

Blade portions 52 and 54 are joined by plates 58, 60, which are inserted between the lower ends of blade portions 52, 54, and affixed thereto, e.g., by suitable arc welding beads. Aligned holes are provided in plates 58 and 60 to close-fittingly receive a pivot rod 62. The outer ends of pivot rod 62 are received in bores in the two side plates 16, 18 of box 12. Thus, blade 50 is pivotably mounted in box 12, on an axis located near the bottom of box 12, and near the end of box 12 remote from tractor 10. It is to be understood that the mounting of blade 50 to be pivotable about an axis located near the lower corners of side plates 16 and 18 remote from tractor 10 is a principal feature of the present invention.

As best seen in FIG. 1, the upper edge of major blade 52 is provided with a pair of ears 64, 66. Ears 64, 66 are themselves provided with aligned transverse bores adapted to receive a pivot pin 68. Suitable retaining means (not shown) of the kind well known to those having ordinary skill in the art are provided for retaining pivot pin 68 in place in the abovesaid aligned bores in ears 64, 66, as shown in FIG. 3.

Going now to FIG. 3, and comparing it with FIG. 2, it will be seen that a block 70 is mounted on pivot pin 68 between ears 64 and 66. Block 70 is so mounted on pivot pin 68 as to be rotatable about the common axis of said aligned bores in ears 64 and 66. The end of piston rod 71 remote from its associated hydraulic cylinder 72 is affixed to block 70.

The end of hydraulic cylinder 72 remote from piston rod 71 is provided, in the well-known manner, with an ear 74, by means of which hydraulic cylinder 72 may be pivotably affixed to suitable mounting ears or the like.

As may best be seen by comparing FIGS. 1 and 3, a pair of ears 76, 78 are affixed to the upper edge of beam 14, and ear 74 of hydraulic cylinder 72 is disposed therebetween. Ears 74, 76, and 78 are provided with aligned bores adapted to receive a pivot pin 80, whereby cylinder 72 is pivotably affixed to beam 14.

Cylinder 72 is provided with a pair of hoses 72*a*, 72*b* (FIG. 2) whereby hydraulic fluid under pressure is supplied to cylinder 72 under the control of one of the driver-operable hydraulic control means mounted on tractor 10 as described hereinabove.

Thus, as may best be understood by reference to FIG. 2, blade 50 may be pivoted about pivot rod 62 by the operator of the device of the invention by manipulation of the corresponding hydraulic control means mounted on tractor 10, and may thus be selectively positioned over a range of angular positions about pivot rod 62. In one of these angular positions the upper part of major blade portion 52 is substantially perpendicular to the plane containing the upper edges of box walls 16 and 18, and the tips of both blade portions 52 and 54 project below the lower edges of box walls 16 and 18.

In one extreme angular position of blade 50, as pivoted about pivot rod 62 by means of hydraulic cylinder 72, the upper edge of major blade portion 52 is located well forward of the intermediate position just described (i.e., in which the upper edge of major blade portion 52 is substantially perpendicular to the plane containing the upper edges of box wall 16 and 18), i.e., more remote from tractor 10 than in said intermediate position.

In the other extreme position of blade 50, as pivoted about pivot rod 62 by means of hydraulic cylinder 72, the upper edge of major blade portion 52 is located well behind the position it occupies when blade 50 is in the abovesaid intermediate position, i.e., is located near or to tractor 10.

It is to be especially noted that in accordance with a principal feature of the present invention the lower edges of blade portions 52 and 54 both project approximately 1½ inches below the plane containing the lower edges of box sides 16 and 18 when blade 50 is in the abovesaid intermediate position, and the upper edge of major blade portion 52 is substantially perpendicular to a plane containing the upper edges (remote from the ground) of box sides 16 and 18, blade 50 being a new blade.

Figure 4:
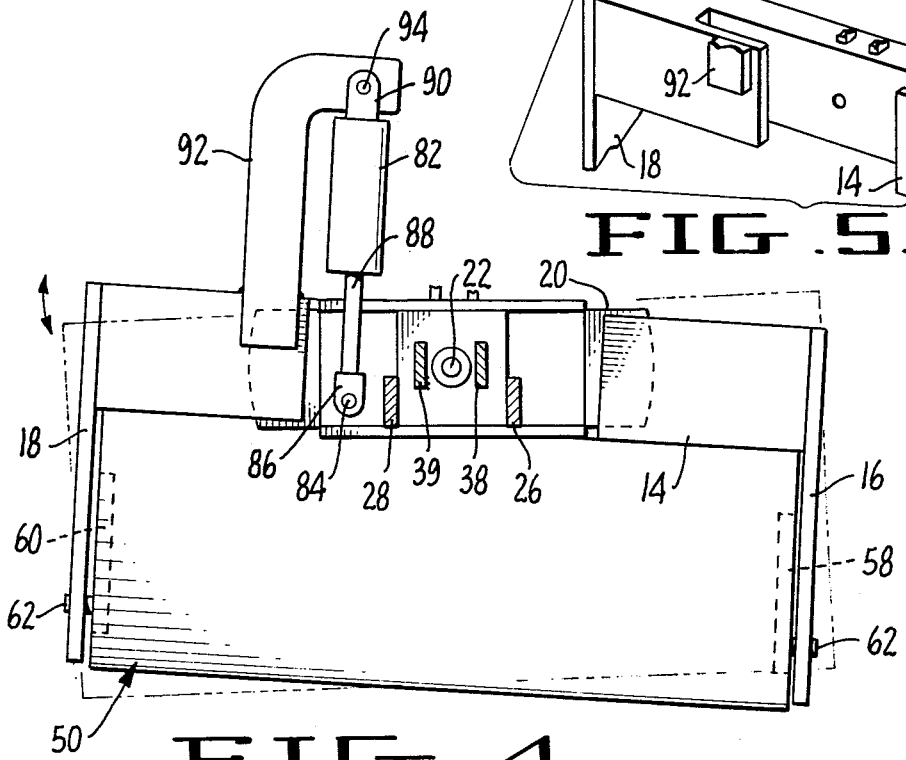
FIG. 4 is a vertical sectional view taken on line 4—4 of FIG. 2.

Referring now to FIG. 4 and 5, there is shown a hydraulic cylinder 82 and the cooperating members whereby hydraulic cylinder 82 may be used by the operator of the scraper of the invention to tilt box 12 and the parts carried by it about the axis of pivot pin 22.

A pivot pin 84 is affixed to plate 20, in the manner shown in FIGS. 4 and 5. A block 86 is pivotably mounted on pin 84, being retained thereon by means well known to those having ordinary skill in the art (now shown).

As best seen in FIG. 4, the end of the piston rod 88 of hydraulic cylinder 82 remote from hydraulic cylinder 82 is affixed to block 84. In the usual manner, the end of hydraulic cylinder 82 opposite piston rod 88 is provided with an ear 90 having a bore for receiving a pivot pin of the well-known kind.

As best seen in FIG. 4, an inverted L-shaped member 92 is provided, the longer leg of which is affixed at its outer end to beam 14, as by arc welding.

The shorter leg of L-shaped member 92 is provided near its outer end with a bore adapted to receive a pivot pin 94, which also passes through a bore in ear 90 affixed to the upper end of hydraulic cylinder 82. Thereby hydraulic cylinder 82 is pivotably affixed to L-shaped member 92.

As best seen in FIg. 2, hydraulic cylinder 82 is provided with a pair of supply hoses 82, 82*b*, whereby hydraulic cylinder 82 is provided with hydraulic cylinder under pressure from a suitable reservoir and pump mounted on tractor 10, it being understood that in some cases it will be desirable to use a single hydraulic cylinder and pump as the source of working fluid under pressure for all three hydraulic cylinders, i.e., 42, 72, and 82.

The operation of hydraulic cylinder 82, like the operation of hydraulic cylinders 42 and 72, may be controlled by the driver of tractor 10 by means of manual control means provided at a conveniently accessible place on tractor 10.

Summarizing, it will be seen from the above that the driver of tractor 10, equipped with the scraper of the present invention, is provided with three readily accessible manual controls by which the driver can (1) raise box 12 and thus scraper blade 50 completely clear of the ground, (2) bring box 12 downward and thus bring scraper blade 50 into contact will the ground (3) exert sufficient downward force on box 12 and blade 50 so as to raise the wheels of tractor 10 adjacent box 12 off the ground, and thus to bring a substantial portion of the weight of tractor 10 to bear on blade 50, (4) manipulate blade 50 between the two extreme positions shown in Fig. 2, and (5) tilt box 12 and blade 50 about pivot pin 22.

In accordance with a principal feature of the present invention, then, the operator of the scraper of the invention can, by means of manual controls conveniently disposed upon tractor 10, bring the weight of the tractor to bear on blade 50.

In accordance with an additional feature of the present invention, the hydraulic control means which control the operation of hydraulic cylinder 42, and thus control the positioning of box 12 and blade 50, may be put in a "mutual" position, wherein hydraulic cylinder 42 neither lifts box 12 nor thrusts it toward the ground, and thus the downward force exerted upon blade 50 is that imposed by box 12, blade 50, and their associated assembly.

In this "neutral" position the spaces on the opposite sides of the piston in hydraulic cylinder 42 are valved directly to a sump, as will be recognized by those having ordinary skill in the art.

Thus, it is a particular feature of the present invention that the scraper of the present invention is characterized by both floating action, in which mode of operation the weight of box 12, blade 50, and their associated assemblies provide the only force bringing the lower edges of blade 50 to bear upon the ground, and down-pressure action in which, in addition, a substantial part of the weight of the tractor is brought to bear on the lower edges of blade 50 in contact with the ground.

It is to be noted that while the abovedescribed pivoting action about pivot pin 22 of box 12 may have a total extent of, say, about 22°, other maximum pivoting or tilting angles about pivot pin 22 also fall within the scope of the present invention.

It will be seen from the above that the present invention, and the preferred embodiment shown and described herein, make possible a new method of scraper operation wherein a substantial portion of the weight of the tractor is brought to bear on the scraper blades, in addition to a method of operation which might be called floating action, analagous in some ways to the operation of the scrapers of the prior art.

It will thus be seen that the objects set forth above, among those made apparent from the preceding description, are efficiently attained, and, since certain changes may be made in carrying out the above-described method of scraper operation and in the above scraper constructions without departing from the scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A scraper attachment for a tractor, comprising:

a scraper blade having a first scraping edge and a second scraping edge;

blade carrier means pivotably mounted on carrier pivot means affixed to one end of said tractor;

blade pivot means for pivotably mounting said blade in said blade carrier means, the location of said blade pivot means in said blade carrier means and the range of pivotal positions of said blade being such that either one of said scraping edges can be selectively positioned below the other and below the lower edge of said blade carrier means; and power-operated blade carrier positioning means for a. raising said blade carrier means and thus raising said blade out of contact with the ground when in a first, powered mode of operation, b. pivoting said blade carrier means downwardly about said carrier pivot means so that one end of said tractor is supported solely by said blade when in a second, powered mode of operation, and, c. permitting said blade to rest upon the ground, bearing the weight of said blade carrier means but not bearing the weight of said tractor, when in a third, unpowered mode of operation;

said blade carrier means comprising a pair of planar side members the lower edges of which constitute said lower edges of said blade carrier means, said blade being located between said planar side members, and said blade pivot means being located near the lower edges of said side members and near the edges of said side members remote from said tractor.

2. A scraper attachment as claimed in claim 1, including power-operated tilting means for tilting said blade carrier means about an axis which is substantially horizontal and substantially normal to a vertical plane containing the axis of said blade pivot means when said tractor is standing on level ground and said power-operated blade carrier positioning means is in said third mode of operation.

3. A scraper attachment as claimed in claim 2, including power-operated blade pivoting means for selectively positioning said blade in selected pivotal positions in said range of pivotal positions.

* * * * *